United States Patent [19]

Marynowski et al.

[11] 4,201,512

[45] May 6, 1980

[54] RADIALLY STAGED DRAG TURBINE

[75] Inventors: Chester W. Marynowski; F. Michael Lewis, both of Mountain View; Charles E. Lapple, Los Altos Hills; Robert G. Murray, Palo Alto; Konrad T. Semrau, Menlo Park, all of Calif.

[73] Assignee: Cerla N.V., Netherlands Antilles

[21] Appl. No.: 826,977

[22] Filed: Aug. 23, 1977

[51] Int. Cl.[2] ..... F01D 1/36

[52] U.S. Cl. ..... 415/90; 415/66

[58] Field of Search ..... 415/64, 66, 68, 69, 415/90

[56] References Cited

U.S. PATENT DOCUMENTS

| | | | |
|---|---|---|---|
| 1,056,338 | 3/1913 | Johnsen | 415/90 |
| 1,061,142 | 5/1913 | Tesla | 415/90 |
| 1,108,831 | 8/1914 | Corthesy | 415/90 |
| 1,179,078 | 4/1916 | Dake | 415/90 |
| 1,434,336 | 10/1922 | Geiger | 415/60 |
| 2,043,788 | 6/1936 | Adair | 415/90 |
| 3,045,428 | 7/1962 | McLean | 415/90 |
| 3,487,784 | 1/1970 | Kafferty | 415/76 |
| 3,872,668 | 3/1975 | Eskeli | 415/64 |
| 4,025,225 | 5/1977 | Durant | 415/90 |

*Primary Examiner*—William L. Freeh

*Attorney, Agent, or Firm*—Alvin E. Hendricson

[57] ABSTRACT

The staging or compounding of drag-type turbines having a high energy input is herein accomplished by disposing successive stages of a drag turbine in radially offset relation, i.e., nested relationship with nozzles between radially displaced stages mounted either in fixed spatial position or mounted for rotation with the upstream rotor and providing either like or opposite directions of rotation of successive stages. The successive radial stages of the present invention are separately coupled to coaxial drive shafts which, in turn, may be appropriately coupled to rotary output means in a conventional manner to provide the output power and high efficiency of the multistaged turbine.

4 Claims, 6 Drawing Figures

RADIALLY STAGED DRAG TURBINE

BACKGROUND OF INVENTION

Of the various types of turbines that have been developed over the years, there is included a type wherein a fluid such as steam or hot gas, for example, moves generally tangentially over the surface of rotatably mounted discs for imparting a rotational force to the discs by friction. This type of turbine is sometimes termed a "friction turbine" and is herein termed a "drag turbine". Early patents on this type of turbine include U.S. Pat. No. 1,061,206 to Tesla and No. 1,056,338 to Johnsen, and numerous subsequent patents have been issued for improvements in this type of turbine.

In general, a drag-type or friction-type turbine includes a pressure-tight, cylindrical casing surrounding a rotor comprised as a plurality of closely spaced discs that are usually flat and parallel to each other and commonly perpendicular to the concentric shaft to which they are attached. A driving fluid such as steam or the like is directed into the casing tangentially of the discs through one or more nozzles and then passes spirally inward between the discs and exits through apertures in the discs near the shaft or through a hollow shaft having apertures between the discs. During spiral passage between the discs, the fluid imparts a tangential force to each disc by virtue of the frictional shear set up at the disc walls, and this creates a torque on the rotor causing the rotor to spin. The ultimate angular velocity attained by the rotor is such that the foregoing torque is balanced by the combined effects of a load on the output shaft, frictional torque on the shaft bearings, and the torque due to windage loss between rotor and casing. In passage through the drag-type turbine, fluid transmits a part of the kinetic energy thereof and part of the momentum thereof to the discs and thence to the attached shaft and load. It is noted that in this type of turbine torque transmission occurs almost entirely by frictional drag, rather than by pressure or impact upon intercepting vanes or blades as in conventional turbines. The magnitude of the torque transmitted from a fluid to a rotor in a drag-type turbine increases with an increase in the relative tangential velocity between fluid and discs, and increases with an increase in the effective area of each disc. Additionally, the magnitude of torque transmitted increases with a decrease in the spacing between discs.

It is additionally noted that for a given velocity of entering fluid the magnitude of the power transmitted to the rotor varies with relative rotor speed, and passes through a maximum when the average absolute rotor speed is about one-half the average absolute tangential fluid speed between discs. Unfortunately, the efficiency of energy transfer is no more than fifty percent at the foregoing large differences in relative velocity between fluid and rotor. For highest energy transfer efficiency, it is desirable to minimize the relative velocity between fluid and discs, at all radial distances along the discs. From the foregoing, it is believed to be clear that it is possible in principle to achieve high efficiency by allowing the rotor to spin at a rate such that the rotor tip speed is only slightly lower than the speed of the entering fluid. However, practical limitations in the tensile strength of rotor materials limit the rotor tip speed. As an example employed further herein, the tip speed may be limited to the order of 1200 to 1500 feet per second. Consequently, a high efficiency drag turbine is limited to utilizing entering fluid speeds of this same order of magnitude.

In common with other types of turbines, the drag-type turbine of the present invention employs one or more nozzles for the purpose of converting the "pressure times volume" energy of the fluid into directed kinetic energy. For those applications wherein the initial pressure of the driving fluid is so low that it cannot be accelerated above the range of 1200 to 1500 feet per second by passage through a nozzle, there is no difficulty in attaining a high efficiency in a single stage drag turbine. This can be readily accomplished by providing adequate disc area and expanding all of the available pressure drop in a first stage, while at the same time allowing the rotor discs to spin fast enough to approach a match of disc tip speed and fluid inlet speed. For many applications, however, the initial pressure of the driving fluid is very high and, consequently, the only feasible way to achieve high efficiency is by multistaging or providing a multiplicity of stages of the drag turbine. Conventional staging of this type of turbine is suggested in the above-noted patent to Johnsen as providing one turbine following another, with the exhaust from the first being passed through nozzles for direction into a second in order to drive a common shaft. This type of multistaging requires separate turbine casings and substantial additional floor space. The present invention provides a highly advantageous alternative to conventional multistaging of drag turbines.

SUMMARY OF INVENTION

The present invention provides an improvement in friction turbines or drag turbines by employing a plurality of separate stages. Basically, the multiple staging of the present invention comprises a series of nested rotors which are mounted to rotate independently of each other and at different angular velocities from each other. Each rotor is provided with a separate output shaft, each of which is concentrically mounted like the rotors and conventional means may be employed for externally combining the output power from the differentially rotating shafts.

The present invention provides turbine nozzles for each stage of the turbine for directing a driving fluid tangentially to the rotor discs at a desired velocity relative to such discs. The relationship of interstage nozzles in accordance with the present invention is susceptible to variation between certain alternatives as briefly noted below. Interstage nozzles may be affixed to the turbine housing or the like, so as to be stationary in space or, interstage nozzles may be mounted to rotate with the upstream rotor for each interstage configuration. Additionally, the interstage nozzles may be oriented in either of two possible rotational senses so that the downstream or successive stage rotor is rotated in the same direction as the preceding stage rotor or in the opposite direction. It will be seen that the foregoing alternatives provide four options, as further explained below, and the option or alternative wherein the interstage nozzles rotate with the preceding stage and produce countercurrent or opposite direction of rotation of the successive stage is advantageous in minimizing the number of necessary stages for a predetermined pressure drop across the turbine.

The present invention is particularly directed to drag turbine applications wherein high pressure inlet fluid is to be employed for driving the turbine rotors. As noted above, the maximum tip speed of a turbine rotor is limited by the available characteristics of construction materials, and yet high efficiency of operation requires a substantial matching of inlet fluid velocity and rotor tip speed. Thus the present invention is particularly directed to applications wherein a number of stages are required to achieve high efficiency operation.

DESCRIPTION OF FIGURES

The present invention is illustrated as to particular preferred embodiments thereof in the accompanying drawings, wherein.

DESCRIPTION OF PREFERRED EMBODIMENTS

The present invention provides multistaging of drag-type turbines by radial displacement or nesting of the rotors of successive stages, with each rotor having a separate output shaft. The present invention is adapted for staging any desired number of successive stages; however, the illustrations and following description are referenced to a two-stage turbine, primarily for the purpose of simplifying the illustrations and description.

Figure 1:
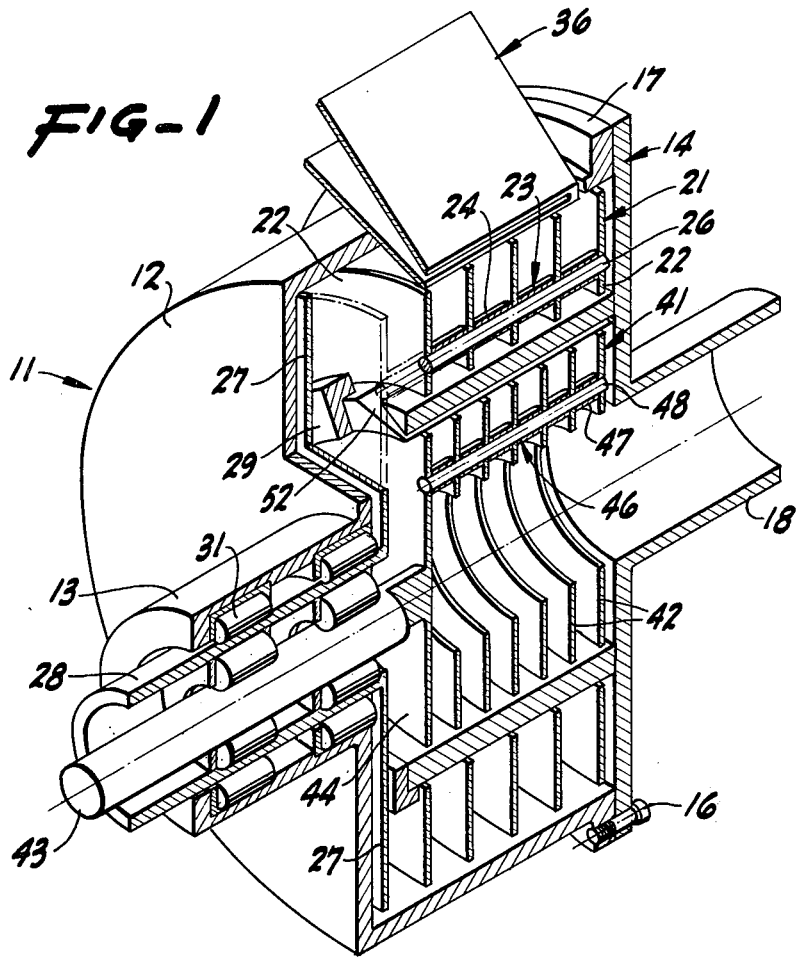
FIG. 1 is a schematic representation of a radially-staged drag turbine in accordance with the present invention.
Figure 2:
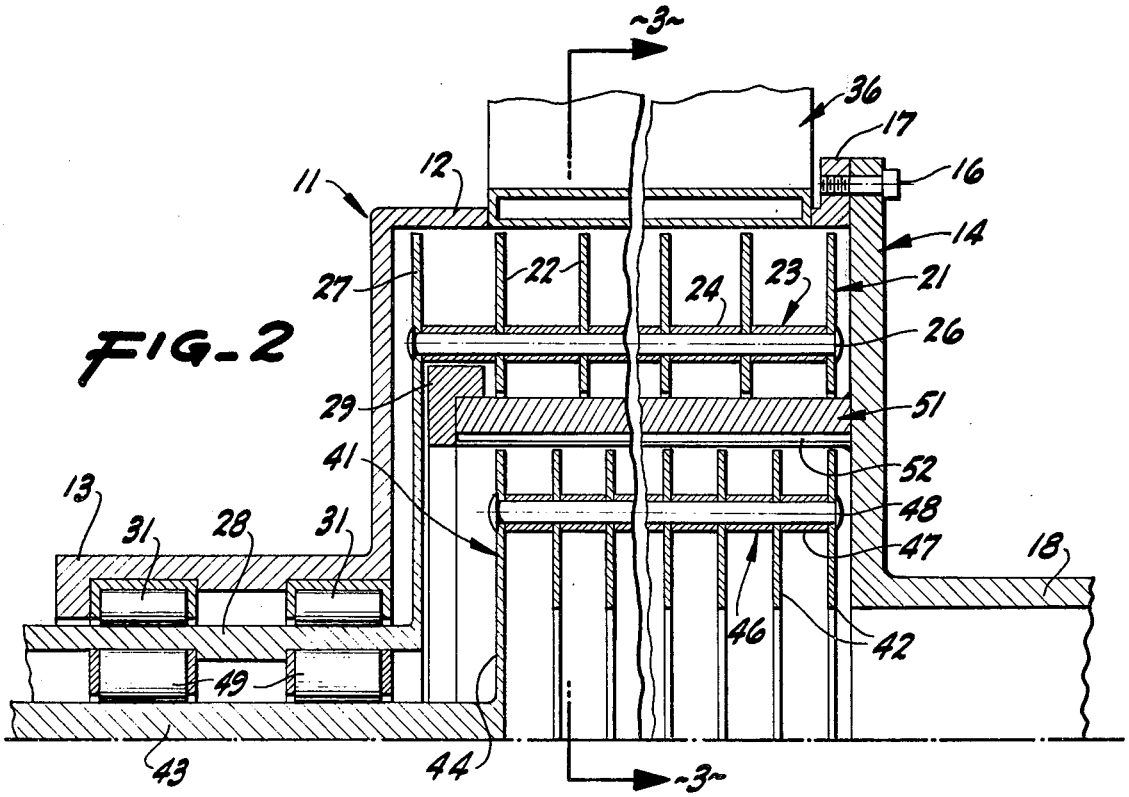
FIG. 2 is a partial, central, longitudinal sectional view of a radially-staged drag turbine having fixed interstage nozzles in accordance with the present invention.
Figure 3:
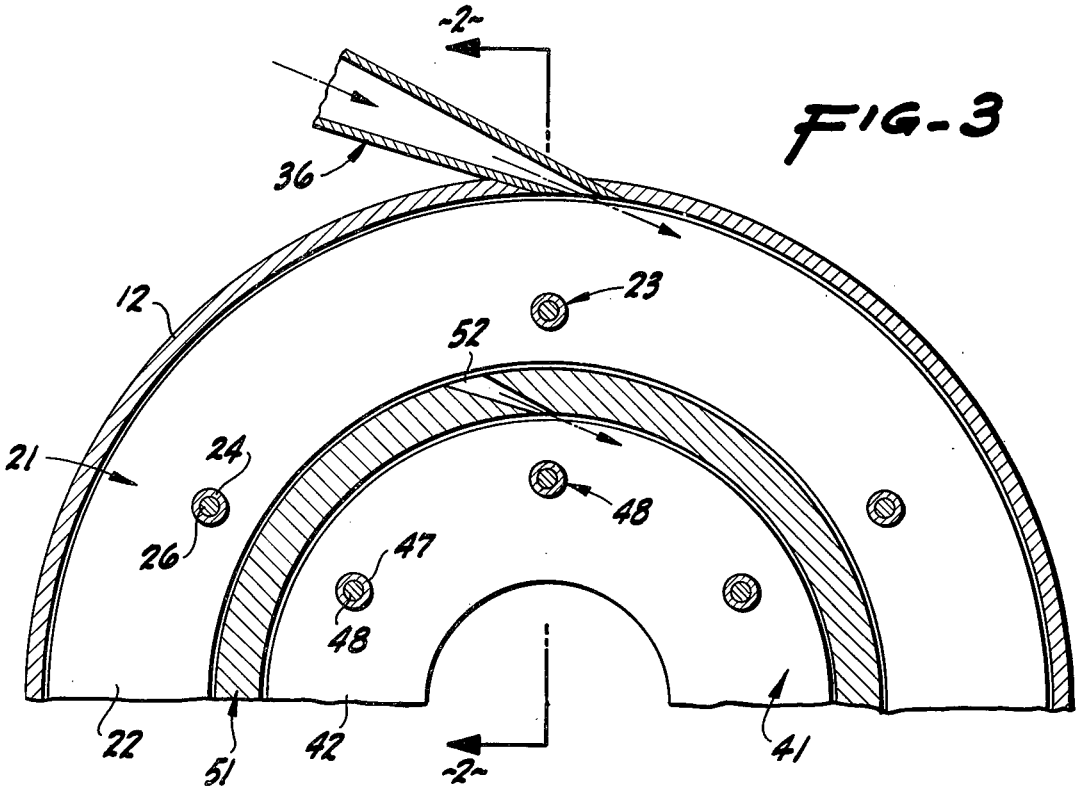
FIG. 3 is a partial, transverse sectional view taken in the plane 3—3 of FIG. 2.

Reference is first made to FIGS. 1, 2 and 3 of the drawings, illustrating one embodiment of a two-stage, radially-offset drag turbine in accordance with the present invention. A turbine casing 11 is shown to be formed as a cylindrical section 12 having an axial extension 13 from one end thereof and having the other end closed by an end plate 14 secured as by bolts or the like 16, to a flange 17, about an otherwise open end of the cylindrical section of the casing. The end plate 14 is provided with a central, hollow, axial extension or exhaust line 18.

Within the casing or housing 11 there is provided a first rotor or first stage 21 comprising a large plurality of closely-spaced parallel discs 22 having the periphery thereof closely spaced from the inner circumference of the axial section 12 of the casing. These discs 22 are annular in configuration, and as illustrated, may comprise flat annular plates or discs, although it is recognized that alternative drag turbine disc configuration may be employed. The discs 22 are spaced apart and mounted in the above-noted parallel spaced relationship by spacing and support means 23, and a plurality of these means may be disposed about the rotor, preferably adjacent the inner circumference of the annular discs thereof. The blade-spacing and support means 23 is shown to include a plurality of short cylindrical spacers or washers 24 disposed one between each pair of blades in alignment across the rotor and having a central support bar or rod 26 extending through the blades and spacers. There is also provided as a portion of the first-stage rotor 21 a circular rotary-mounted end plate 27 disposed adjacent the end wall of the casing 11 and having a cylindrical, axial extension or hollow shaft 28 extending through the axial extension 13 of the casing 11. The support rods 26 hold the discs together and these rods are mounted on the end plate 27 for supporting the discs of the first-stage rotor on the end plate 27. It will also be appreciated that cylinders or washers of the blade-spacing means 23 of the first-stage rotor extend into engagement with the end plate 27, as shown. The hollow shaft 28 of the first-stage rotor is mounted for rotation by bearings 31 mounted about this hollow shaft within the axial extension 13 of the casing 11.

It will be seen from the drawings and the above description that the first-stage rotor is formed of a plurality of closely-spaced annular discs mounted for rotation within the casing 11 upon the hollow shaft 28 extending from the end plate thereof. The spacing between adjacent discs of the rotor 21 is exaggerated in the drawings for the purpose of clarity of illustration; however, it is noted that these discs are actually spaced quite closely together in conformity with general practices for drag turbines or friction turbines.

The first-stage rotor is rotated by a fluid directed into the casing 11 by first-stage nozzle means 36. The present invention is adapted to employ a wide variety of different relatively high pressure fluids such as, for example, combustion products of coal and coal dust which may contain entrained particles. The present invention is particularly adapted to use with hot and dirty combustion products which may initially be provided at a high pressure. The first-stage nozzle means 36 extends through the cylindrical section 12 of the casing in such a direction as to direct a driving fluid tangentially to the discs 22 of the first-stage rotor. The physical configuration of the nozzle means may be widely varied, and the nozzle means may, as illustrated, comprise only a single nozzle opening extending axially across the first-stage rotor or, alternatively, may comprise a plurality of nozzles arranged in the stated direction for directing a fluid between the first-stage discs 22. The nozzle 36 is particularly designed in accordance with conventional practice to convert the "pressure times volume" energy of the gas or fluid into kinetic energy of the fluid at a desired velocity of fluid flow. In accordance with the present invention, fluid is directed into the casing through the primary or first-stage nozzle means 36 at a velocity of the order of 1600 feet per second under the conditions that the tip speed of the first-stage discs may reach 1500 feet per second. Alternatively, the fluid velocity is decreased if physical configurations and materials require lower tip speed for the first-stage rotor discs.

Within the housing or casing 11 there are also provided additional stages of the drag turbine of the present invention. Referring again to FIGS. 1 to 3, there will be seen to be illustrated a second stage or second-stage rotor 41 disposed concentrically within the first-stage rotor 21 and including a plurality of closely-spaced, parallel, annular discs 42 mounted for rotation upon an output shaft 43 by means of an end plate or end disc 44. The second-stage rotor discs 42 are mounted and spaced apart by second-stage spacing and support means 46 which includes small cylindrical spacers 47 disposed about a support rod or bar 48 extending through the discs in contact therewith and physically attached to at least the end discs. A plurality of second-stage disc spacing and support means 46 are provided about the circumference of the second-stage discs, preferably adjacent the radially inner edges thereof, as illustrated. These spacing and support means serve not only to insure proper spacing and parallelism of the discs, but also to support the discs, i.e., to mount the discs upon the end disc or end plate 44.

The output shaft 43 of the second-stage rotor is disposed axially of the casing 11 in extension through the axial extension 13 of the casing and is carried by bearings 49 disposed about the shaft 43 within the hollow shaft 28 of the first-stage rotor.

With regard to the driving of the second-stage rotor 41, it is noted that the present invention provides second-stage nozzle means 52 mounted in or formed as a part of an annular secondary nozzle ring 51 disposed between the first- and second-stage rotors. This nozzle ring is closely spaced from the inner circumference of the primary rotor discs 22 and also is closely spaced from the outer circumference of the second rotor discs 42. The secondary nozzle ring 51 is illustrated in the drawings to include a single nozzle 52 extending laterally across the two rotors, i.e., axially of the nozzle ring, and this nozzle is formed somewhat as shown to direct a driving fluid tangentially to the secondary rotor discs 42 adjacent the outer periphery thereof. The secondary or interstage nozzle ring 51 may have one or more nozzles 52 extending therethrough at a single circumferential location or may have such nozzle or nozzles 52 disposed at a plurality of locations about the circumference of the nozzle ring 51.

The purpose of the secondary nozzle or nozzles 52 is to convert the "pressure times volume" energy of the fluid leaving the first stage of the turbine into directed kinetic energy of the fluid having a predetermined absolute velocity of flow. This fluid velocity should substantially equal the tip speed of the secondary rotor discs for maximum efficiency of energy conversion in the turbine. In common with the first stage, the secondary stage is rotated by frictional engagement of the driving fluid with the secondary rotor discs and this fluid spirals inwardly in passage through the second stage until most of the available energy has been removed therefrom and the fluid then enters the circular opening in the center of the secondary rotor and passes axially out of the turbine through the exhaust line or manifold 18 in the casing end plate 14. It is also possible to exhaust this fluid into a hollow output shaft through openings therein between the secondary rotor discs.

In the embodiment of the present invention illustrated in FIGS. 1 to 3, the secondary nozzle or nozzles 52 are fixed in space, i.e., the secondary nozzle ring 51 is mounted upon the casing end plate 14. It is desirable, from the standpoint of rotor balance and bearing life, to provide for multiple, symmetrically spaced nozzle openings about the circumference of each stage, but this is not an essential part of the invention. Preferably, the nozzle ring is stiffened at the free hanging end thereof by a support ring 53, which may have somewhat of an inverted L shape in axial cross-section, as shown, and which is secured as by welding to the end of the nozzle ring. This support ring 53 is structurally advantageous in stiffening the nozzle ring particularly when the ring is formed in a number of segments that are joined together to form a full circle. The stiffening or support ring 53 is dimensioned to fit inside of the first-stage end plate 27, as shown in FIG. 2, and in order not to interfere with the rotation of either the first-stage or second-stage rotor. As noted above, the present invention embraces certain alternatives with respect to the mounting and type of interstage nozzles, as discussed below; however, the basic purpose of interstage nozzles is to limit the pressure drop across the preceding stage and to establish the inlet velocity of driving fluid for the following stage. The interstage nozzles and nozzle-mounting means, such as the illustrated secondary nozzle ring, separates successive stages so that each stage can operate, and in fact is operated, independently of the preceding stage. In this manner maximum energy may be extracted from an initial input fluid having a high pressure and temperature, for only a desired amount of energy need be removed in each stage of the turbine, and this then provides the capability of limiting the maximum rotor tip speed for each stage and yet attaining a highly efficient energy transfer in each stage. As previously noted, a drag turbine or friction turbine of the type improved upon by the present invention provides for most efficient energy transfer when the velocity of inlet fluid is only slightly greater than the tip speed of rotor discs operated upon by the fluid. Thus the staging of drag turbines is clearly required for high-pressure driving fluids, and the present invention provides a materially improved staging system wherein successive stages are nested or radially offset. It is also noted that the number, separation and radial depth of the discs in each stage may be varied, so as to extract a desired and a predetermined amount of energy from the fluid passing through the stage. It is contemplated by the present invention that successive stages shall rotate at different velocities and, as noted below in further detail, successive stages may also rotate in opposite directions.

With the radially-staged turbine described above and illustrated in FIGS. 1 to 3, it is possible to provide a compact, high efficiency drag turbine operable with high-pressure inlet fluid. As previously noted, the output shafts 28 and 43 are driven to rotate by the first and second-stage rotors, respectively, to provide the output power of the turbine. Conventional means may be employed for utilizing this output power and thus no details thereof are included herein. It is also noted that many conventional structural details of turbines are excluded from the illustration of the present invention and description thereof, for the sake of clarity. Thus, for example, it is desirable to minimize the leakage of fluid between stages except through the interstage nozzles and, similarly, the turbine casing is to be provided with appropriate means to prevent leakage of fluid therefrom. Similarly, the leakage of fluid into the bearings 31 and 49 is to be minimized, again in relatively conventional fashion.

Operation of the radially-staged drag turbine illustrated in FIGS. 1 to 3 is believed to be apparent from the foregoing description of this embodiment of the present invention; however, certain points may be noted with regard to the most efficient manner of operating this turbine. The motive fluid, such as a hot gas or the like, is expanded in the first-stage inlet nozzle or nozzles 36 into the turbine casing from an initial fluid pressure to some intermediate pressure. The magnitude of the intermediate pressure is controlled by the conditions that are maintained in subsequent stages and by the final exhaust pressure maintained at the outlet of the turbine. The fundamental criterion is that the intermediate pressure should be adequately high relative to the initial pressure to prevent the motive fluid from being accelerated to an excessive speed or velocity as it expands through the first-stage inlet nozzle. It is ideal from a standpoint of energy efficiency for the speed of the fluid entering the first-stage rotor to be only slightly higher than the maximum safe rotor tip speed. Thus, for example, the inlet fluid velocity may be of the order of 1600 feet per second, if the first-stage rotor is permitted to have a tip speed of 1500 feet per second; however, it will be appreciated that the stated difference of 100 feet per second in this and foregoing examples is illustrative only, and may be either larger or smaller in specific cases.

As the fluid spirals inwardly between each pair of discs in the first stage of the rotor, the tangential velocity of the fluid changes continuously and the rate of change of velocity is governed by the rate at which angular momentum is transferred to the first-stage rotor discs. If there were a negligibly small transfer of momentum, the fluid would accelerate as it spiraled inwardly; however, if sufficient disc area is provided to attain a significant momentum transfer the fluid will accelerate less rapidly during the first part of the spiral and will then decelerate during the final part. If an even greater disc area is provided, the fluid will decelerate through the entire spiral because of the transfer of momentum to the discs through friction. As an illustration, a turbine may be designed to provide an adequate disc area to cause the fluid to decelerate throughout its inward spiral so that the final tangential velocity of the fluid leaving the first-stage discs is only slightly higher than the velocity of the first-stage discs at their inner radius. It is noted that in a radially-staged drag turbine the ratio between the inner and outer disc radii in a given stage is not as critical as for a single-stage version because successive inner stages may be employed to recover excess kinetic energy of fluid leaving the outer stage. One practical manner of turbine design employing the present invention employs stages that are all equal in radial extent, and various stages are provided with different numbers of discs and thus different disc separations so as to ensure an adequate, but not excessive, disc area in each stage. Extraction of equal quantities of energy in two radially-staged rotors may be accomplished by providing a greater radial extent to the second-stage rotor discs as in FIG. 1, or by increasing the number of second-stage rotor discs as in FIG. 2, assuming a like pressure drop across each stage.

Assuming, as stated above, that the fluid leaving the first-stage discs has a negligibly low tangential velocity relative to the inner radius of these discs, it is yet true that the fluid will have a non-negligible velocity relative to a stationary interstage nozzle or nozzles. By suitably contouring the interstage nozzles, the majority of the approach velocity can be conserved and redirected into the next stage. Additionally, the fluid velocity can be augmented as the fluid expands and accelerates through the interstage nozzles so that the fluid may be caused to have a velocity substantially equal to the fluid velocity entering the first stage. The foregoing may be achieved by virtue of the fact that a second increment of fluid pressure drop is expended in the interstage nozzles. It is noted that the recovery of fluid energy corresponding to the approach velocity to the secondary nozzles inherently incorporates certain inefficiencies because of the substantial velocity difference involved, and this is further discussed below in connection with the embodiment of the present invention illustrated in FIGS. 4 and 5. The operation of successive radially nested stages of the present invention is entirely analogous to that of the first stage, as briefly described above, except that the final stage has no nozzles at the inner circumference thereof. The small residual angular momentum and kinetic energy in the effluent gas from the final stage is merely expended in downstream turbulence and friction losses.

Figure 4:
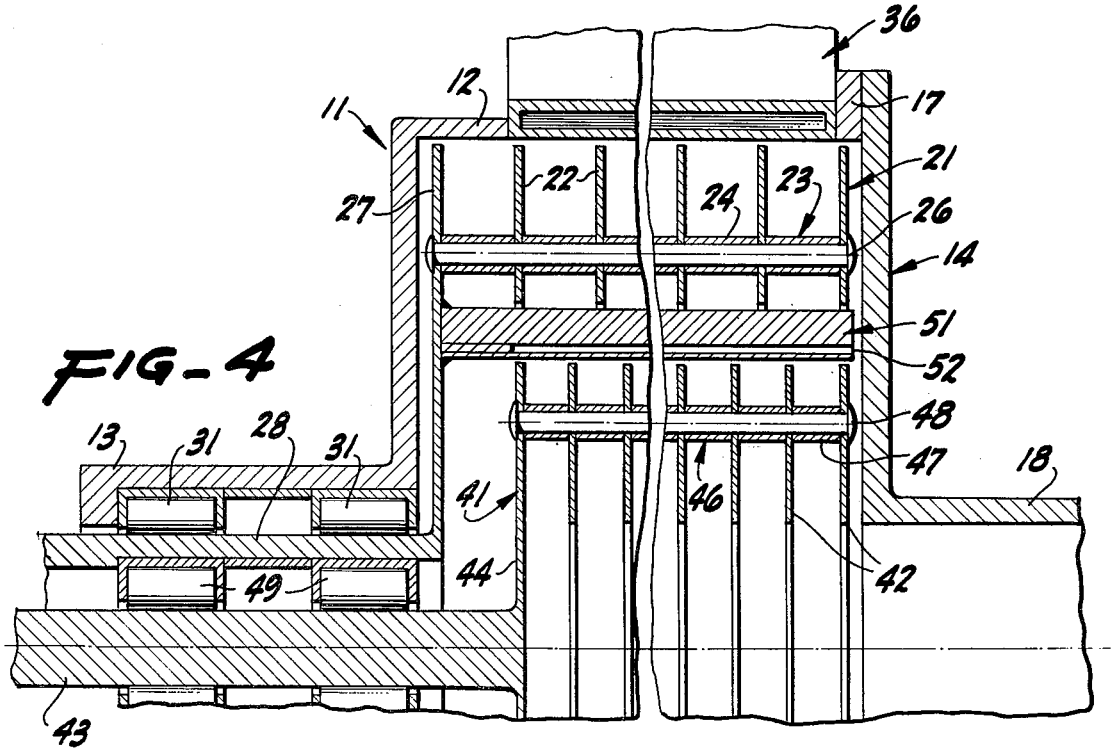
FIG. 4 is a partial, central, longitudinal sectional view of a radially-staged drag turbine having rotary mounted interstage nozzles in accordance with the present invention.

The radially-nested multistaged turbine of the present invention is capable of certain alternatives including the mounting of interstage nozzles for rotation with the preceding stage. In this respect, reference is made to FIG. 4 of the drawings, wherein elements that are the same as in FIGS. 1 to 3 are similarly numbered. The second-stage nozzle ring 51 of FIG. 4 is shown to be physically mounted upon the first-stage end plate 27. The nozzle ring 51 is not mounted on the casing 11, but instead is mounted for rotation with the first-stage rotor 21. Although certain disadvantages of this rotating nozzle embodiment may arise in connection with the difficulty and/or expense of construction, certain possibly unobvious advantages attach thereto. In the foregoing example of the present invention wherein the fluid leaving the first-stage rotor discs has a neglibible tangential velocity relative to the discs, it will be seen that the fluid also has a negligible approach velocity relative to interstage nozzles that are rotating with the first-stage rotor. Consequently, there are less thermodynamic irreversibilities involved in the passage of the fluid from the first stage into the interstage nozzles, and hence the efficiency is inherently higher for the embodiment of the present invention employing rotating nozzles.

The interstage nozzles operate in the same way upon the fluid, whether the nozzles are stationary or rotary mounted. However, an additional effect must be taken into consideration when the nozzles are rotating. With the interstage nozzles rotating, these nozzles act as a "reaction turbine" wherein any angular momentum created in the fluid passing through the nozzles must be counterbalanced by an oppositely directed angular momentum imparted to the nozzles and consequently to the entire upstream or first-stage rotor to which the nozzles are attached. With the interstage nozzles oriented in the direction of FIGS. 1 and 3, for example, in order to drive the second-stage rotor in the same direction as the first stage, the net effect of the "reaction turbine" is to reduce the torque available at the first-stage output shaft.

Figure 5:
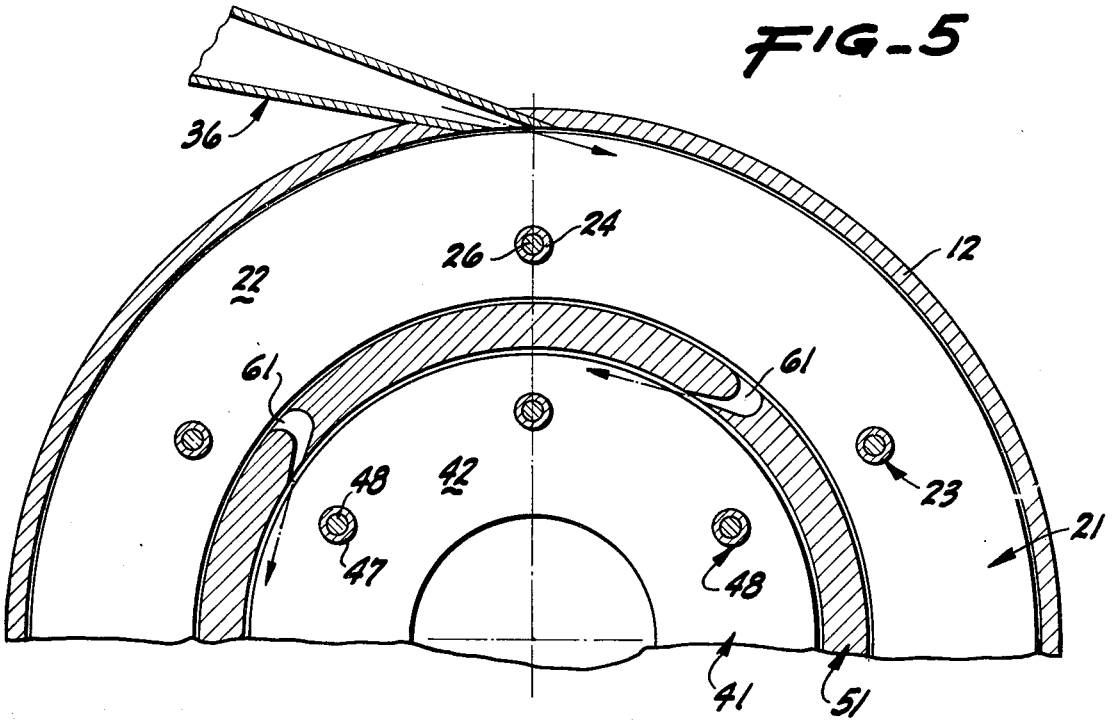
FIG. 5 is a partial, transverse sectional view of a radially-staged drag turbine taken in a plane similar to plane 3—3 of FIG. 2 and illustrating curved counterflow nozzles.

In addition to the alternatives available with the present invention of mounting interstage nozzles, either stationary with respect to the turbine casing or integrally with the preceding rotor stage for rotation therewith, it is possible in accordance herewith to employ countercurrent or reverse flow nozzles, wherein the direction of fluid flow relative to the casing 11 is reversed by the nozzles. In this respect, reference is made to FIG. 5 of the drawings wherein an interstage nozzle ring 51 is illustrated to include one or more counterflow nozzles 61 incorporating a 180° bend between inlet and outlet. The term "counterflow nozzles" does not necessarily imply 180° curved nozzles; it does necessarily imply that the nozzles are so oriented that their exit direction is opposite to the exit direction of the nozzles in the preceding stage. The nozzle 61 will be seen to be oriented to readily receive fluid leaving the inner radius of the first stage and to direct this fluid generally tangentially to the periphery of the second-stage rotor. The curved counterflow nozzles of FIG. 5 are primarily intended for use in the present invention with stationary nozzles, as described above. In general, the provision of counterflow nozzles in the stationary nozzle embodiment of the present invention is less advantageous for many applications than other embodiments of the present invention. As noted above, the present invention is adapted for use with a relatively high-pressure input fluid such as gases of combustion, and wherein these gases may include entrained particles so as to be termed "dusty". Reverse flow or countercurrent nozzles that are stationary between stages suffer from a higher erosion rate and deposit rate than nozzles which do not reverse the direction of fluid flow, such as illustrated in FIGS. 1 to 3 of the drawings.

Figure 6:
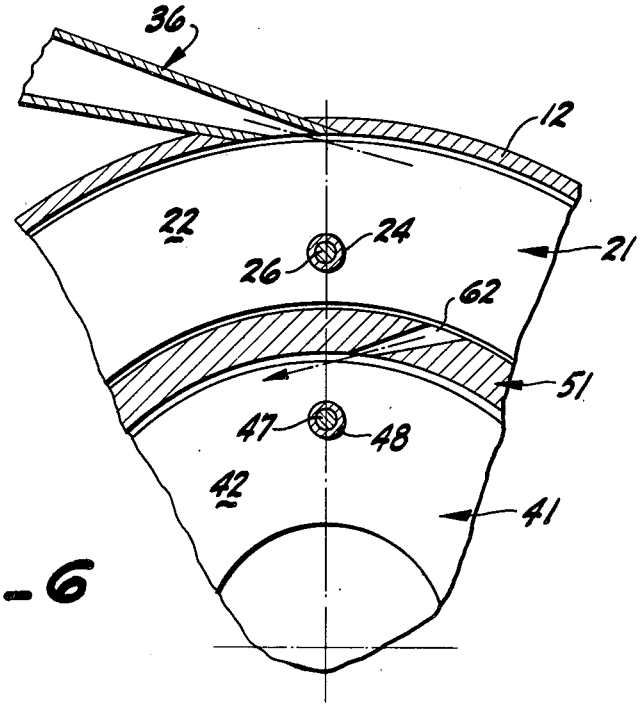
FIG. 6 is a partial, transverse sectional view illustrating an arrangement of first- and second-stage nozzles for use in a counterflow rotating interstage nozzle embodiment of the invention.

The embodiment of the present invention employing counterflow rotating nozzles is particularly advantageous, inasmuch as the velocity of the fluid entering the counterflow nozzle is quite low relative to the nozzles. The net effect of a rotating counterflow nozzle is to increase the output of the rotor upon which the nozzles are mounted. Moreover, because of the opposed rotation of adjacent stages in the counterflow case, a higher pressure drop can be tolerated through the interstage nozzles without producing an intolerably high absolute fluid velocity into the following state. It will thus be seen that fewer stages are required with rotating counterflow nozzles to achieve the equivalent efficiency to that of the rotating cocurrent flow situation, under the conditions wherein geometrical configurations are otherwise the same. With the turbine designed to reduce the fluid velocity to about the tangential velocity of the inner radius of the first-stage rotor discs, it will be seen that the fluid has almost no velocity relative to the second-stage nozzle ring. Consequently, it is not necessary to employ curved nozzles to redirect the fluid, and a nozzle arrangement such as shown in FIG. 6 may be employed for a counterflow rotating nozzle arrangement. The second-stage nozzle 62 will be seen to be shown merely as the reverse of the nozzle 52 of FIG. 1, for example. It is noted with respect to the turbine nozzles illustrated herein that no attempt has been made to incorporate nozzle design for this field is well known in the art. For example, nozzles are often provided with a constricted throat and expanding discharge section, and conventional turbine nozzles of this and other types are applicable to this invention within the general limitations set forth herein.

Both of the rotating nozzle embodiments of the present invention are inherently more efficient than either of the stationary nozzle embodiments. It is also to be noted that both of the rotating nozzle embodiments of the present invention are inherently less subject to erosion by particles carried by the fluid than either of the stationary embodiments, inasmuch as the rotating nozzle embodiments employ a negligible tangential approach velocity for the fluid.

It will be seen that there has been described above an improvement in drag turbines or friction turbines, particularly with respect to the staging or compounding of this type of turbine. In the conversion of energy from a high-pressure flow of fluid that may contain or entrain particles, it is believed to be clear that drag-type turbines are advantageous in minimizing erosion of turbine parts, inasmuch as the direct impingement of the fluid upon turbine blades is precluded. The present invention consequently provides a material advancement in the conversion of fluid flow energy to rotational energy, particularly under the circumstances noted above. The radial staging of drag-type turbines as provided herein is also advantageous in precluding the necessity of multiple turbine casings and minimizing the power plant floor space required for any particular application. Although a plurality of embodiments of the present invention have been disclosed, it is noted that particular advantage attaches to the stationary interstage nozzle embodiment with cocurrent flow through the nozzles because of the simplicity of construction and to the rotary interstage nozzles with countercurrent or reverse current flow of the fluid because of the improved efficiency. Although the present invention has been described with respect to particular preferred embodiments thereof, it will be appreciated by those skilled in the art that additional modifications and variations of the present invention are possible within the scope of the present invention and, consequently, it is not intended to limit the invention to the particular terms of description or precise details of illustration.

What is claimed is:

1. An improved multistage drag turbine comprising:

a cylindrical casing having nozzle means extending substantially tangentially therethrough for directing a driving fluid into the casing at a predetermined velocity and an axial opening for exhausting said fluid from said casing, a first-stage rotor having a plurality of parallel closely-spaced annular discs closely fitting the interior circumference of said casing and having an end plate carrying said discs and including a first shaft extending axially from said casing, a second-stage rotor communicating with said axial casing opening and having a plurality of parallel closely-spaced discs disposed radially inward of said first-stage rotor and mounted for rotation upon a second shaft extending from said casing concentrically with said first shaft of said first-stage rotor, and an annular nozzle ring disposed between said first and second stage rotors and mounted on said first stage rotor for rotation therewith with at least one interstage nozzle extending therethrough for directing fluid from said first stage rotor in a direction substantially opposite to the direction of rotation of said first stage rotor and substantially tangentially onto discs of said second stage rotor adjacent the periphery thereof at a predetermined velocity, whereby said first and second-stage rotors are separately driven in opposite directions of rotation at predetermined rotational velocities to utilize a maximum amount of fluid energy.

2. An improved multistage drag turbine comprising at least two radially spaced turbine stages with each having a rotor mounted on a shaft and said shafts being concentric, a single housing surrounding said turbine stages and having nozzle means extending therethrough for direction fluid substantially tangentially into the outer stage, a nozzle ring disposed between each of said radially spaced stages and mounted upon the radially outward stage for rotation therewith and having interstage nozzle means extending therethrough in a direction substantially opposite to the direction of rotation of the nozzle ring for directing fluid from each stage into the adjacent radially inward stage therefrom, and exhaust means communicating with the center of said housing within the innermost stage.

3. The turbine of claim 2 further defined by said first stage reducing the fluid velocity to the order of the velocity of the inner radius of the first stage rotor thereat and a plurality of said interstage nozzles having substantially the same configuration as said nozzle means whereby fluid is directed substantially tangentially into said second stage rotor at a velocity substantially the same as the inlet velocity to said first stage.

4. An improved drag turbine comprising a cylindrical casing having nozzle means extending substantially tangentially therethrough for directing a driving fluid into the casing in a first direction at a predetermined velocity and having an axial opening for exhausting said fluid from said casing, an annular rotor having a plurality of parallel closely spaced annular discs closely fitting the interior circumference of said casing for rotation in said first direction by frictional engagement with said driving fluid, and an annular nozzle ring mounted on the inner circumference of said rotor and having nozzles extending therethrough in a direction substantially opposite to said first direction of rotation of said rotor for exhausting said driving fluid from said rotor to further propel the rotor in said first direction.

* * * * *